US009693425B2

(12) United States Patent
Feustel et al.

(10) Patent No.: US 9,693,425 B2
(45) Date of Patent: Jun. 27, 2017

(54) WEARABLE HEADLAMP

(71) Applicant: LED Lenser Corp. Ltd., Guangdong Province (CN)

(72) Inventors: Stefan Feustel, Berlin (DE); Andre Kunzendorf, Wuppertal (DE)

(73) Assignee: LED Lenser Corp. Ltd., Yangjiang (CN)

( * ) Notice: Subject to any disclaimer, the term of this patent is extended or adjusted under 35 U.S.C. 154(b) by 347 days.

(21) Appl. No.: 14/151,361

(22) Filed: Jan. 9, 2014

(65) Prior Publication Data

US 2014/0198484 A1 Jul. 17, 2014

(30) Foreign Application Priority Data

Jan. 14, 2013 (CN) ..... 2013 1 0013511

(51) Int. Cl.

| | |
|---|---|
| ***F21V 21/08*** | (2006.01) |
| ***H05B 37/02*** | (2006.01) |
| ***F21L 4/00*** | (2006.01) |
| ***F21L 4/04*** | (2006.01) |
| ***F21V 21/084*** | (2006.01) |

(Continued)

(52) U.S. Cl.

CPC ..... *H05B 37/02* (2013.01); *F21L 4/00* (2013.01); *F21L 4/04* (2013.01); *F21V 21/084* (2013.01); *F21V 23/0464* (2013.01); *F21L 4/02* (2013.01); *F21Y 2113/13* (2016.08); *F21Y 2115/10* (2016.08)

(58) Field of Classification Search

CPC ..... F21V 21/084; F21V 23/0471; F21V 23/0492; F21V 21/30; F21V 21/14; F21V 29/004

USPC ..... 362/103–107

See application file for complete search history.

(56) References Cited

U.S. PATENT DOCUMENTS 4,447,863 A 5/1984 Fenne
6,457,841 B1 10/2002 Lynch et al.

(Continued)

FOREIGN PATENT DOCUMENTS

JP 1992-102101 10/1993
JP 2002-166873 A 6/2002

(Continued)

OTHER PUBLICATIONS

Office Action for Japanese Application No. 2013-266286 dated Sep. 14, 2015.

(Continued)

*Primary Examiner* — William Carter
(74) *Attorney, Agent, or Firm* — Alston & Bird LLP

(57) ABSTRACT

A wearable headlamp is provided that may provide improved illumination control and adjustability. The wearable headlamp may include a primary light-emitting diode (LED) configured to illuminate an area in front of the headlamp and a photosensor configured to detect the level of ambient light surrounding the headlamp and adjust the luminous flux of the light emitted by the primary LED accordingly. Additionally, the headlamp may include an alternate, red LED to provide illumination where the brightness of the primary LED is not suitable. Furthermore, both the primary LED and alternate LED may be secured within a pivotable lamp housing that enables the direction of the light emitted from the LEDs to be adjusted.

11 Claims, 5 Drawing Sheets

(51) Int. Cl.

| | |
|---|---|
| ***F21V 23/04*** | (2006.01) |
| *F21L 4/02* | (2006.01) |
| *F21Y 115/10* | (2016.01) |
| *F21Y 113/13* | (2016.01) |

(56) References Cited

U.S. PATENT DOCUMENTS

| | | | | |
|---|---|---|---|---|
| 6,966,668 | B2 | 11/2005 | Cugini et al. | |
| 8,148,912 | B2 | 4/2012 | Kim | |
| 8,894,231 | B2 | 11/2014 | Kwok | |
| 2004/0240198 | A1 | 12/2004 | Van Laar et al. | |
| 2005/0099799 | A1* | 5/2005 | Cugini | F21L 14/00 362/105 |
| 2007/0171084 | A1 | 7/2007 | Potter | |
| 2007/0171629 | A1 | 7/2007 | Langewalter | |
| 2008/0205036 | A1 | 8/2008 | Tarter et al. | |
| 2008/0316736 | A1* | 12/2008 | Hunnewell | A45C 15/06 362/187 |
| 2011/0050123 | A1 | 3/2011 | Duerr et al. | |
| 2011/0157875 | A1 | 6/2011 | Hunnewell et al. | |
| 2012/0057331 | A1* | 3/2012 | Janice | F21L 4/02 362/105 |
| 2012/0298887 | A1 | 11/2012 | Stevens | |
| 2013/0301242 | A1* | 11/2013 | Sharrah | F21V 21/084 362/105 |

FOREIGN PATENT DOCUMENTS

| | | | |
|---|---|---|---|
| JP | 2007-528546 | A | 10/2007 |
| JP | 2007-538356 | A | 12/2007 |
| JP | 2008-258144 | A | 10/2008 |
| JP | 2010-262922 | A | 11/2010 |

OTHER PUBLICATIONS

Office Action from corresponding Japanese Application No. 2013-266286, dated Dec. 18, 2014.

Office Action from corresponding Australian Application No. 2013273610, dated Sep. 12, 2014.

European Search Report for Application No. EP 13 00 5950 dated Apr. 22, 2016.

* cited by examiner

WEARABLE HEADLAMP

CROSS REFERENCE TO RELATED APPLICATIONS

This application claims priority to Chinese Application No. 201310013511.2, filed Jan. 14, 2013, which is incorporated herein by reference in its entirety.

TECHNOLOGICAL FIELD

Various embodiments of the present invention described herein generally relate to wearable headlamps and, in particular, to wearable headlamps having improved illumination control and adjustability.

BACKGROUND

Wearable headlamps are frequently used to provide illumination for various sporting and commercial endeavors. As an example, many sporting headlamps are provided with an elastic head band that allows hikers and climbers to wear the headlamps on their head or helmet in order to provide hands-free visibility in low-light conditions. Headlamps of this type are often used, for example, when navigating a trail at night, pitching a tent in darkness, or performing an early morning alpine ascent. These headlamps may also be adapted to provide hands-free illumination in commercial and public safety environments, such as low-light constructions sites or during a fire rescue.

However, wearable headlamps known in the art have a number of drawbacks. In the applications described above, there is often a need to adjust the intensity of the light emitted from the headlamp. A hiker navigating a trail in darkness would require a high-intensity beam of light to see the path in front of him, but would prefer a much lower intensity beam when looking down at a map, which would be nearly blinding if illuminated by a high-intensity beam. Moreover, excessively bright light may cause the user's eyes to over-adjust when viewing an illuminated surface, which can limit subsequent low-light visibility (e.g., when viewing stars through a telescope).

Although existing headlamps include light sources configured to emit light having a manually adjustable luminous intensity, it can be inconvenient for users to repeatedly adjust the luminous intensity of the emitted light manually, particularly during the involved activities described above. Existing headlamps also include limited options for otherwise adjusting the intensity or wavelength of light emitted from the headlamp. Thus, there is an ongoing need in the art for a headlamp capable of adjusting the luminous intensity of its emitted light more conveniently than existing headlamps, and for a headlamp with a greater range of illumination options to suit a wider variety of applications.

Certain headlamps are further adapted such that their light sources can be moved or otherwise adjusted in order to redirect emitted light. For example, climbers may find it useful to direct the emitted light forward and in front of them during an alpine ascent, but may wish to direct the emitted light downward when tying off a rope or engaging a belay device. However, directionally adjustable headlamps in the art are often difficult to redirect or prone to being inadvertently adjusted during use.

In addition to the above, the light sources used in existing headlamps must dissipate the heat that is generated. As an example, certain existing headlamps utilize heat sink devices contained within a housing to dissipate large amounts of heat generated by the headlamp's light source (e.g., an LED). However, dissipating heat generated by a light source via internal heat sinks of this type can cause the housing itself to heat, rendering the headlamp uncomfortable for a user to wear.

BRIEF SUMMARY

Various embodiments of the present invention are directed to a wearable headlamp. According to various embodiments, the wearable headlamp includes a photosensor configured for detecting ambient light and a light source configured to emit visible light having a luminous flux that varies based at least in part on the ambient light detected by the photosensor.

For example, the wearable headlamp of one embodiment may include a housing including at least one fastener configured for securing the headlamp to a user's head; a photosensor operatively connected to the housing, the photosensor being configured for detecting ambient light and for generating an electrical signal corresponding to the detected ambient light; and a light-emitting diode operatively connected to the housing, wherein the light-emitting diode is configured to emit visible light having a luminous flux that varies based at least in part on the electrical signal generated by the photosensor such that the luminous flux of the light emitted by the light-emitting diode decreases in response to an increase in the detected ambient light and increases in response to a decrease in the detected ambient light.

BRIEF DESCRIPTION OF THE DRAWINGS

Figure 1:
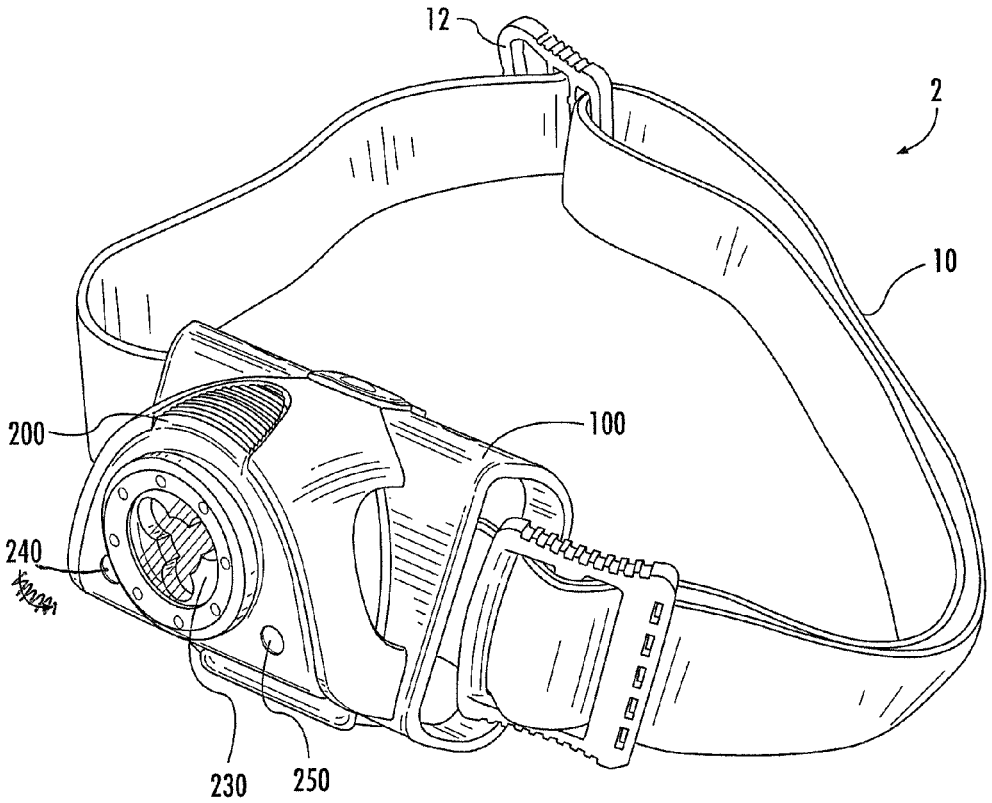
Figure 2:
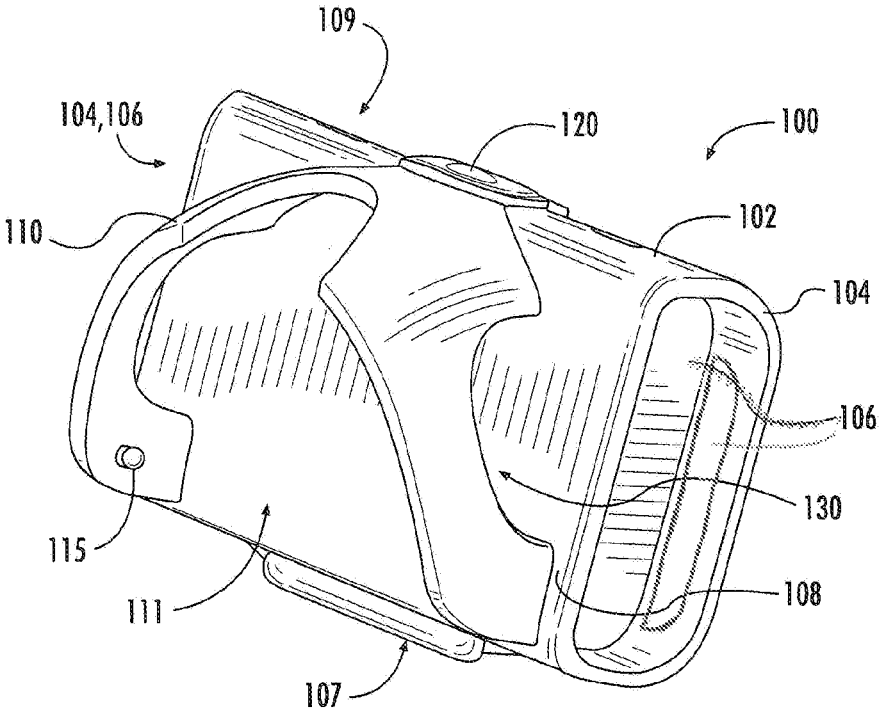
Figure 3:
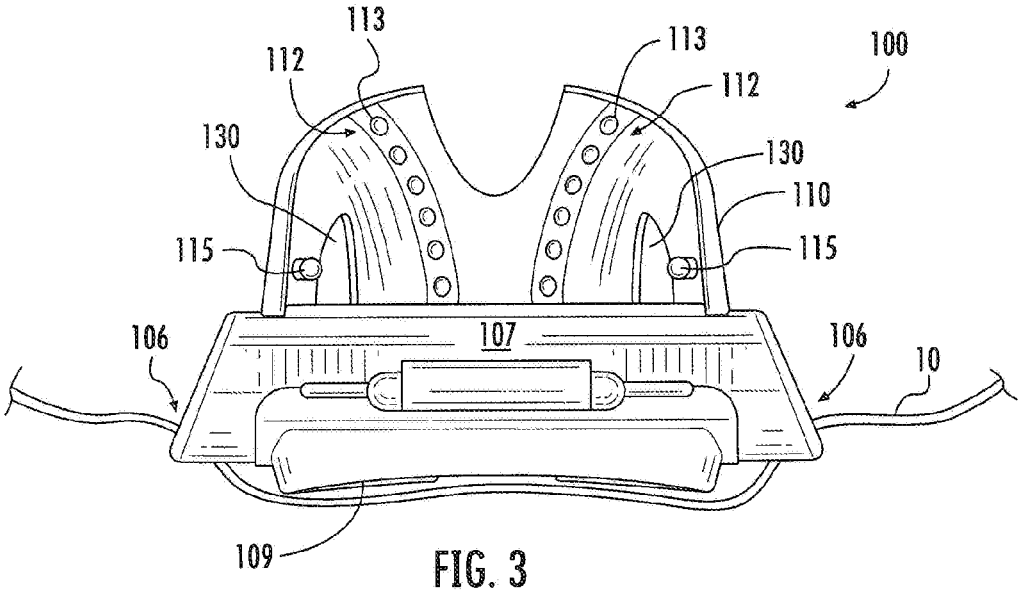
Figure 4:
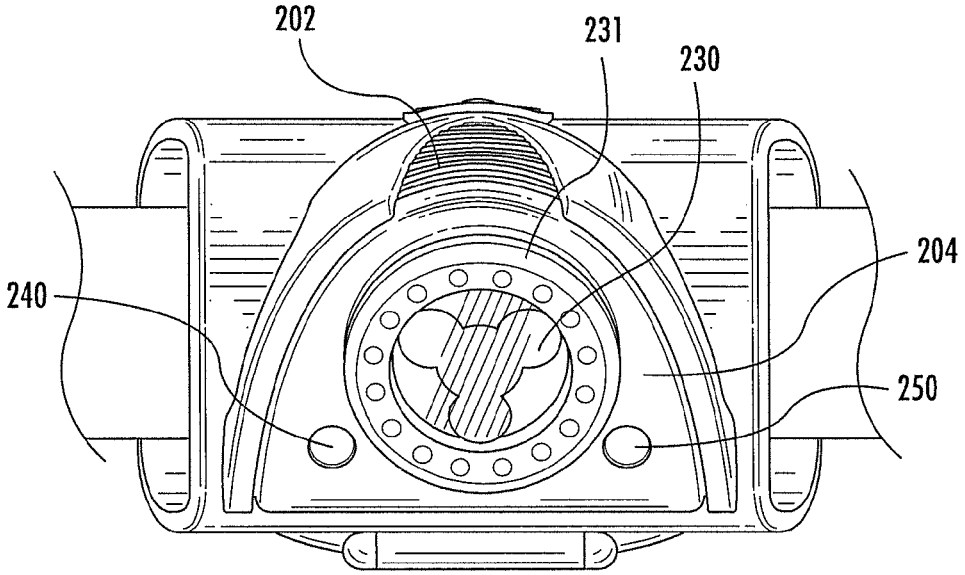
Figure 5:
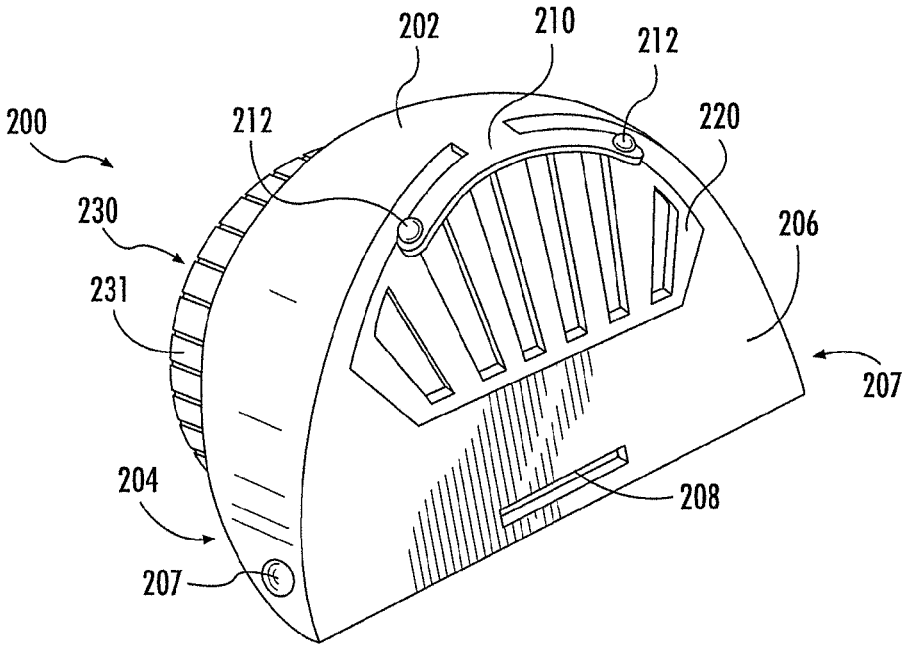
Figure 6:
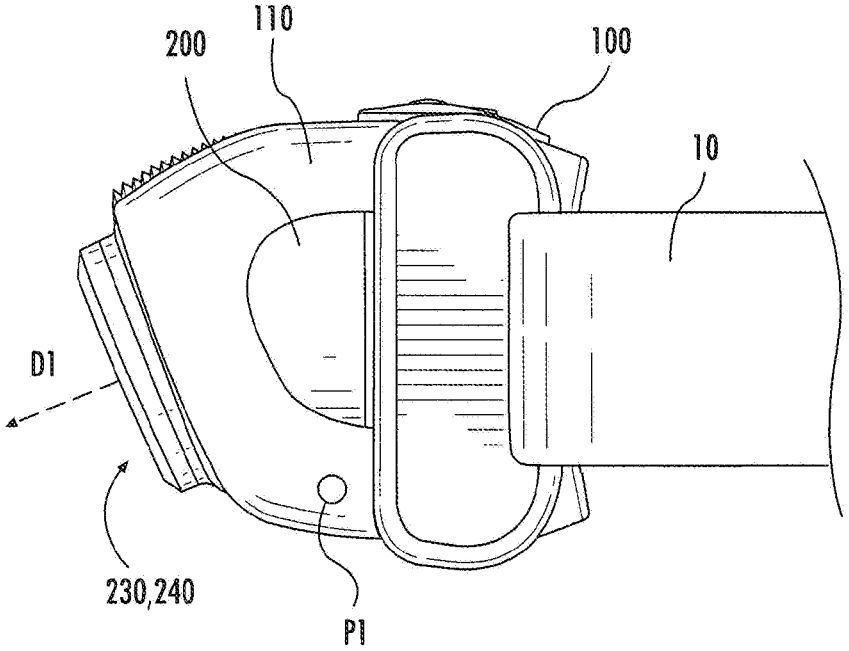
Figure 7:
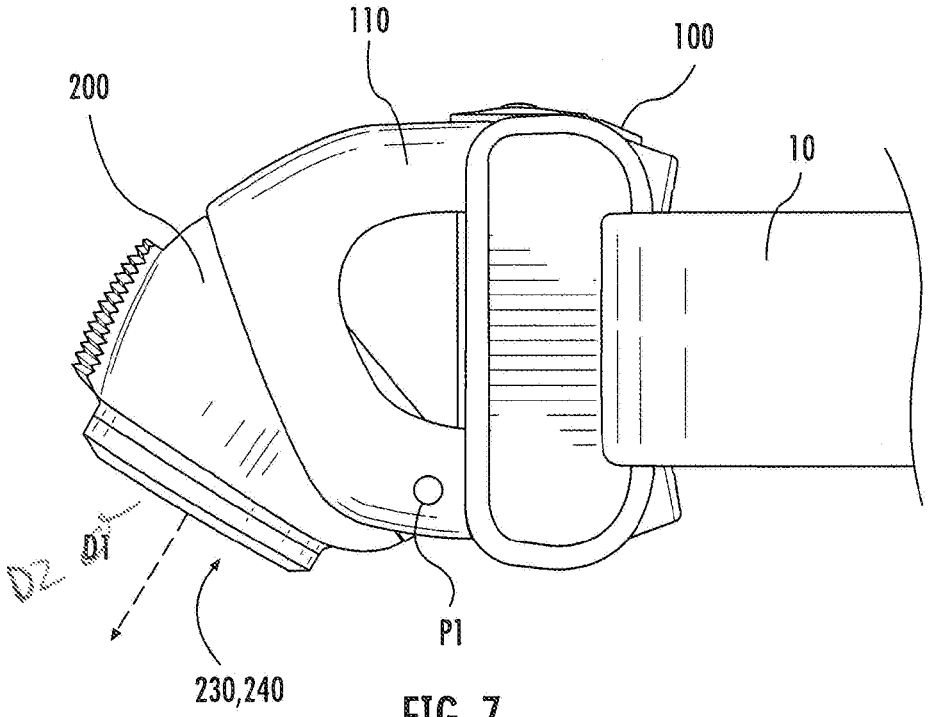
Figure 8:
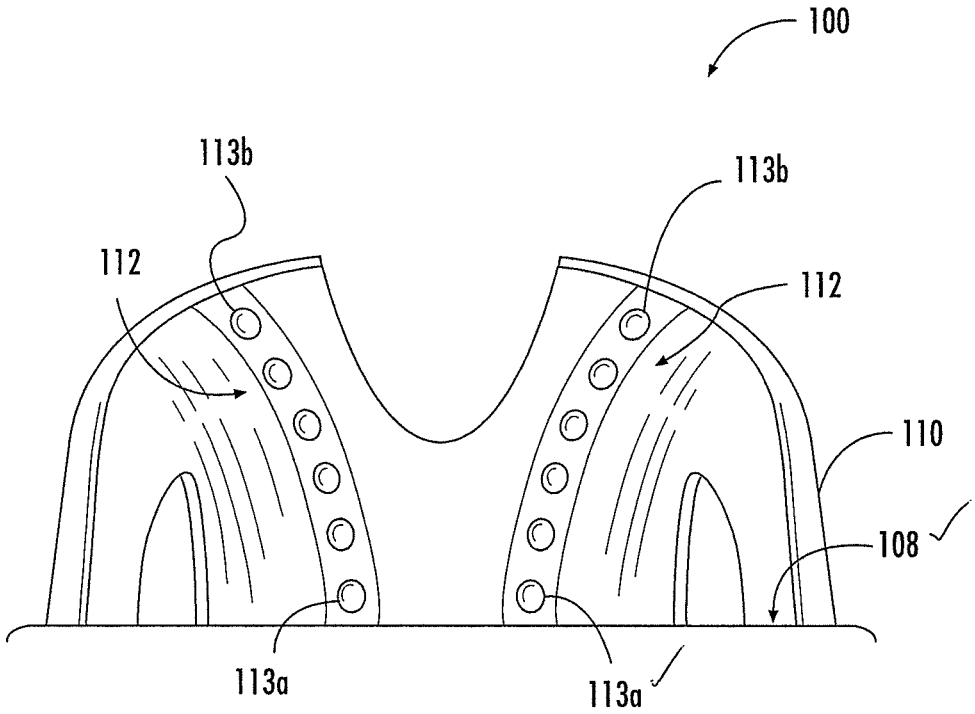

Having thus described certain embodiments of the invention in general terms, reference will now be made to the accompanying drawings, which are not necessarily drawn to scale, and wherein:

FIG. 1 is a perspective view of a headlamp according to one embodiment of the present invention;

FIG. 2 is a perspective view of a main housing of the headlamp according to one embodiment of the present invention;

FIG. 3 is a bottom plan view of the main housing of the headlamp according to one embodiment of the present invention;

FIG. 4 is a front plan view of a lamp housing of the headlamp according to one embodiment of the present invention;

FIG. 5 is a rear perspective view of the lamp housing of the headlamp according to one embodiment of the present invention;

FIG. 6 is a side plan view of the headlamp in which the lamp housing is pivoted to an upper, forward-looking position according to one embodiment of the present invention;

FIG. 7 is a side plan view of the headlamp in which the lamp housing is pivoted to a lower, downward-looking position according to one embodiment of the present invention; and FIG. 8 is a detailed bottom plan view of the main housing of the headlamp according to one embodiment of the present invention.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Various embodiments of the present invention are generally directed to a wearable headlamp having improved illumination control and adjustability. As described in greater detail below, various embodiments of the wearable headlamp include a primary light-emitting diode (LED) configured to illuminate an area in front of the headlamp and a photosensor configured to detect the level of ambient light surrounding the headlamp and adjust the luminous flux of the light emitted by the primary LED accordingly. Additionally, according to certain embodiments, the headlamp includes an alternate LED to provide illumination where the brightness of the primary LED is not suitable. Both the primary LED and alternate LED are also secured within a pivotable light housing that enables the direction of the light emitted from the LEDs to be adjusted.

Wearable Headlamp

FIG. 1 shows a wearable headlamp 2 according to one embodiment of the present invention. As shown in FIG. 1, the headlamp 2 generally comprises a main housing 100, a lamp housing 200, and a head band 10. As described in greater detail below, the lamp housing 200 is pivotably connected to the main housing 100 and includes a primary LED 230, an alternate LED 240, and a photosensor 250, which function together to provide various illumination modes for illuminating an area in front of the headlamp 2. In addition, the head band 10 is secured to the main housing 100 such that the wearable headlamp 2 may be worn around a user's head or helmet (e.g., with the main housing 100 and lamp housing 200 secured proximate the user's forehead), thereby providing hands-free illumination for the user. In the illustrated embodiment, the headband 10 also includes a carabiner clip 12 configured secure the headlamp 2 to other features (e.g., a user's backpack, belt, or the like).

FIG. 2 provides a more detailed view of the main housing 100 according to one embodiment. As shown in FIG. 2, the main housing 100 is generally defined by an upper wall 102, a pair of side walls 104 defining apertures 106, a lower wall 107, a front wall 108, and a rear wall 109. According to various embodiments, the main housing 100 is configured for housing the headlamp's control circuit and power supply (e.g., a rechargeable battery). In addition, the main housing 100 includes a depressible button 120 provided on the upper wall 102. As described in greater detail below, the depressible button 120 functions as a user input device to control the various illumination modes of the headlamp 2. However, according various other embodiments, any suitable user input device—such as a switch, touch sensor, or the like—may be used in addition to, or in lieu of, the button 120 to control the various illumination modes of the headlamp 2.

The main housing 100 also includes a retention member 110, which extends outwardly from the main housing's front wall 108. In the illustrated embodiment of FIG. 2, the retention member 110 has a generally arcuate profile and defines an inner cavity 111. In addition, lateral sides of the retention member 110 define a pair of openings 130 and a pair of inwardly protruding pins 115. As explained in greater detail herein, the retention member's pins 115 function to pivotably engage the headlamp's lamp housing 200, while the openings 130 serve as vents for the cavity 111 that allow heat to escape from a heat sink provided on the lamp housing's rear wall.

FIG. 3 shows a bottom view of the main housing 100, which illustrates, among other things, the inner wall of the retention member 110. As shown in FIG. 3, the retention member's inner wall defines two rows 112 of dimples 113. In the illustrated embodiment, the dimples 113 each comprise rounded, recessed portions of retention member's inner wall and are sequentially spaced along each row 112. As described in greater detail herein, the dimples 113 function as spaced surface engagement features and are configured to engage a mating surface engagement feature on the lamp housing 200.

FIG. 3 also illustrates a portion of the headlamp's head band 10, which is threaded through apertures 106 defined on the main housing's side walls 104. The head band 10 functions as a fastener for the headlamp 2. For example, when the head band 10 is secured around a user's head or helmet, the main housing 100—and thereby the lamp housing 200 as well—may be secured to the user's forehead. Generally, reference herein to the headlamp being secured to a user's head is intended to refer to the headlamp's ability to be secured directly to a user's head, to a helmet, or to another head-mounted apparatus. However, as will be appreciated from the description herein, various other embodiments of the headlamp 2 may include other fasteners in addition to, or in lieu of, the head band 10. Indeed, various fasteners—including snaps, clips, hook and loop fasteners, and the like—may be provided in order to secure to headlamp 2 to various parts of a user's body, clothing, or equipment.

FIGS. 4 and 5 show a front view and rear perspective view of the lamp housing 200, respectively. In the illustrated embodiment, the lamp housing 200 is generally defined by an outer wall 202, a front wall 204, and a rear wall 206. As shown in FIG. 4, the headlamp's primary LED 230, alternate LED 240, and photosensor 250 are positioned on the front wall 204 of the lamp housing 200. In particular, the primary LED 230 is provided in the center of the front wall 204 and is surrounded by a rotatable bezel 231. According to various embodiments, the primary LED 230 may be, for example, a Cree XP-G2 configured to emit white light in order to illuminate the area in front of the headlamp 2. According to various embodiments, the luminous flux of the primary LED may be any suitable value based on intended use of the headlamp 2 and capabilities of commercially available LEDs. As an example, in certain embodiments, the luminous flux of the primary LED may be adjustable between approximately 15 lumens and 200 lumens. Additionally, the rotatable bezel 231 surrounding the primary LED 230 can be rotated to adjust the focus of the primary LED 230 between a wide and narrow area. As described in greater detail below, the luminous intensity of the light emitted by the primary LED 230 can be controlled by adjusting its luminous flux and focus.

In the illustrated embodiment of FIG. 4, the alternate LED 240 is positioned slightly below and to the left of the primary LED 230. According to various embodiments, the alternate LED 240 may be, for example, a Nichia NSPR510GS-E configured to emit light of a predefined color, such as red light, in order to illuminate the area in front of the headlamp 2. According to various embodiments, the luminous flux of the alternate LED may be any suitable value based on intended use of the headlamp 2 and capabilities of commercially available LEDs. In certain embodiments, the luminous flux of the red light emitted by alternate LED 240 may be less than that of the primary LED 230 (e.g., 2 lumens). Generally, the alternate LED 240 may be particularly useful where a user is viewing objects in low-light (e.g., looking at a stars through a telescope) and needs to briefly illuminate an area in front of the headlamp 2 without causing his or her eyes to adjust and impair night visibility. Indeed, the red light emitted by the alternate LED 240 is sufficient to visibly illuminate a close object in low light (e.g., a map) without causing the user's eyes to significantly adjust and impair night visibility. According to various other embodiments, the alternate LED 240 may comprise an LED configured to emit visible light in other spectrums (e.g., blue or green light).

Opposite the alternate LED 240, the photosensor 250 is positioned slightly below and to the right of the primary LED 230. According to various embodiments, the photosensor 250 is configured to detect the level of ambient light surrounding the headlamp 2. As described in greater detail below, the photosensor 250 is configured to generate an electrical signal corresponding to the detected ambient light, which is subsequently used as an input for feedback control of the primary LED 230. According to various embodiments, the photosensor 250 may include, for example, an I2C bus interface, a human-eye grade spectral response, a 50 Hz to 60 Hz light noise reject function, and an illuminance to digital converter.

Referring now to FIG. 5, the rear wall 206 of the lamp housing 200 includes a heat sink 220. In the illustrated embodiment, the heat sink 220 comprises a thermally conductive metal plate having a plurality of fins extending outwardly from the rear wall 206. According to various embodiments, the heat sink 220 serves to dissipate heat generated by the LEDs 230, 240 positioned on the front wall 204 of the lamp housing 200. In particular, the positioning of the heat sink 220 on the rear wall 206 of the lamp housing 200 enables dissipating heat to escape through the openings 130 defined on lateral sides of the retention member 110. Additionally, as will be appreciated from FIGS. 1-8, the retention member 110 partially surrounds the lamp housing 200 and thereby serves as a guard preventing a user's fingers from inadvertently contacting the surface of the heat sink 220.

The rear wall 206 of the lamp housing 200 also includes a cable port 208. The cable port 208 serves as a connection point for a cable that connects the control circuit in the main housing 100 with the LEDs 230, 240 and photosensor 250. As explained in greater detail below, the control circuit is thereby able to control the various illumination modes of the LEDs 230, 240.

In the illustrated embodiment, the lateral sides of the outer wall 202 define a pair of pin holes 207, each of which is dimensioned to receive one of the retention member's pins 115. The engagement of the pins 115 with the pin holes 207 enables the lamp housing 200 to be positioned substantially within the cavity 111 of the retention member 110 (e.g., as shown in FIG. 1) and pivot relative to the main housing 100 (e.g., about a pivot point P1 as shown in FIGS. 6 and 7). For example, FIG. 6 illustrates the lamp housing 200 pivotably connected to the main housing 100 and pivoted to an upper, forward-looking position relative to the main housing 100. In the position of FIG. 6, the lamp housing's LEDs 230, 240 are generally aimed in a first direction D1 such that they illuminate an area well in front of the user when the headlamp 2 is secured to the user's head or helmet (e.g., the portion of a trail in front a user when hiking). However, as shown in FIG. 7, the lamp housing 200 can be pivoted to a lower, downward-looking position relative to the main housing 100. In the position of FIG. 7, the lamp housing's LEDs 230, 240 are generally aimed in a second direction D2 such they illuminate an area directly in-front of the user (e.g., a map held below the user's head).

To enable the lamp housing 200 to be pivoted between a plurality of mechanically defined, fixed positions, the lamp housing 200 also includes a mating retention member 210 configured to engage the main housing's retention member 110. As shown in FIG. 5, the mating retention member 210 extends outwardly from an upper edge of the lamp housing's rear wall 206. In the illustrated embodiment, the mating retention member 210 defines a pair of rounded protrusions 212 on its lateral sides. Each of the rounded protrusions 212 is dimensioned to engage one of the dimples 113 defined on the inner wall of the main housing's retention member 110. In this way, each of the rounded protrusions 212 functions as a mating surface engagement feature.

In particular, the lamp housing's mating retention member 210 is positioned relative to the retention member 110 such that the engagement of the rounded protrusions 212 with the dimples 113 holds the lamp housing 200 in a stable position relative to the main housing 100 absent deliberate force applied by a user. However, the engagement of the rounded protrusions 212 with the dimples 113 is weak enough such that, upon application of deliberate force by a user, the rounded protrusions 212 will disengage from the dimples 113 and the lamp housing 200 will pivot in the direction of the force applied by the user until the rounded protrusions 212 engage the next pair of dimples 113. Thus, the engagement of the rounded protrusions 212 with the dimples 113 permits the lamp housing 200 to pivot relative to the main housing 100 between a number of mechanically defined positions upon application of deliberate force by a user. In this way, the direction of light emitted by the LEDs 230, 240 relative to the main housing 100 may be adjusted.

For example, FIG. 8 shows a more detailed, bottom view of the main housing's retention member 110. With the lamp housing 200 pivoted to the upper, forward-looking position of FIG. 6, the mating retention member's rounded protrusions 212 would engage the pair of dimples 113*a* positioned nearest to the main housing's front wall 108. Likewise, with the lamp housing 200 pivoted to the lower, downward-looking position of FIG. 7, the mating retention member's rounded protrusions 212 would engage the pair of dimples 113*b* positioned furthest from the main housing's front wall 108. As will be appreciated from FIG. 8, the plurality of pairs of dimples 113 positioned between the dimple pairs 113*a* and 113*b* enable the lamp housing 200 to be pivoted between a plurality of mechanically defined positions between, and including, the positions shown in FIGS. 6 and 7. In this way, direction of light emitted from the lamp housing's LEDs 230, 240 may be adjusted.

Headlamp Operation & Control

As noted above, the headlamp's main housing 100 is configured for housing the headlamp's control circuit and power supply. According to various embodiments, the control circuit may be an integrated circuit configured to control the headlamp's LEDs 230, 240, while the power supply may comprise a rechargeable battery pack or disposable batteries. In various embodiments, the headlamp's control circuit is configured with a plurality of illumination modes that alter various aspects of the light emitted by the headlamps 230, 240. As an example, in one embodiment, the headlamp's control circuit is configured with the following illumination modes: (1) a high constant brightness mode, (2) a low constant brightness mode, (3) an auto-dim mode, (4) a flash mode, and (5) a red light mode. As used herein, high and low designations are utilized in a relative sense in that the high constant brightness mode has more contrast than a low constant brightness mode without any connoting any particular level of brightness. As described in greater detail below, a user may toggle between the various illumination modes using the headlamp's button 120.

According to various embodiments, with the control circuit in the high constant brightness mode, the primary LED 230 will emit visible light having a relatively high, constant luminous flux (e.g., 200 lumens) and a high luminous intensity (e.g., 4325 candela). By contrast, with the control circuit in the low constant brightness mode, the primary LED 230 will emit visible light having a relatively low, constant luminous flux (e.g., 15 lumens) and a low luminous intensity (e.g., 342 candela). In the low constant brightness mode, the luminous flux of light emitted by the primary LED 230 is less than the luminous flux of the light emitted when the primary LED 230 is in the high constant brightness mode. In both the high constant brightness and low constant brightness modes, the alternate LED 240 is not illuminated and the luminous flux of the primary LED 230 is not adjusted based on feedback from the photosensor 250. However, in either mode, the luminous intensity of the primary LED 230 may be adjusted by rotating the bezel 231 in order to focus the emitted light over a smaller or larger area.

When switched to the auto-dim mode, the control circuit monitors the level of ambient light surrounding the headlamp 2 based on the aforementioned electrical signal generated by the photosensor 250. The control circuit then automatically adjusts the output of the primary LED 230 to correspond to the level of ambient light detected by the photosensor 250. For example, where the control circuit detects that the level of ambient light surrounding the headlamp 2 has decreased, the control circuit will cause the power supply to increase the current supplied to the primary LED 230 and thereby increase the luminous flux of light emitted by the primary LED 230. Likewise, where the control circuit detects that the level of ambient light surrounding the headlamp 2 has increased, the control circuit will cause the power supply to decrease the current supplied to the primary LED 230 and thereby decrease the luminous flux of light emitted by the primary LED 230. In this way, the headlamp 2 is able to automatically adjust the intensity of light emitted by the primary LED 230.

In the flash mode, the control circuit causes the primary LED 230 to flash (e.g., by intermittently emitting no visible light and visible light of constant luminous flux). In this mode, the alternate LED 240 is not illuminated. In the red light mode, the primary LED 230 is turned off and the alternate LED 240 is turned on to emit visible light in the red spectrum having a constant luminous flux (e.g., 2 lumens). Accordingly, in the red light mode, only light within the red spectrum is emitted and the headlamp 2 is able to illuminate a surface near the user without causing the user's eye's to significantly adjust and impair night visibility.

Various Embodiments

As will be appreciated from the description herein, various modifications to the headlamp 2 are contemplated as being within the scope of the present invention. For example, various embodiments of the headlamp 2 may include retention members, mating retention embers, surface engagement features, and mating surface engagement features differing from those shown in FIGS. 1-8. For example, according to various embodiments, the retention member 110 may include a single row of dimples 113, or a plurality of rows of dimples 113, or even a different type of retention mechanism. Likewise, the mating retention member 210 may include a single rounded protrusion 212, or a plurality of rounded protrusions 212, or another type of mating retention mechanism. In other embodiments, the dimples 113 and protrusions 212 may not have a rounded shape and may define protruded and recessed surface areas having other suitable profiles. Additionally, in certain embodiments, the retention member 110 may define rows of protruded surface portions while the mating retention member 210 defines recessed surface portions.

In addition, various embodiments of the retention member 110 may be defined from a single piece of material also defining the main housing 100, or may be defined by a separately formed material attached to the front wall of the main housing 100. Additionally, various embodiments of the retention member may not have an arcuate profile and may not define an interior cavity 111. For example, in certain embodiments, the main housing 100 may include a pair of retention members extending outwardly from lateral sides of the main housing 100 (e.g., the lamp housing 200 including corresponding mating retention members defined on lateral sides of the lamp housing 200). In further embodiments, the lamp housing 200 may be pivotably secured to the front wall of the main housing 100 as opposed to the retention member.

Moreover, various other embodiments of the headlamp 2 may include less or additional light sources. For example, certain embodiments may not include the alternate LED 240. In addition, in certain embodiments, the primary LED 230 may be replaced with another light source, such as an incandescent bulb that functions analogously.

CONCLUSION

Many modifications and other embodiments of the present invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A wearable headlamp comprising:

a first housing having at least one outwardly extending retention member and including at least one fastener configured for securing the headlamp to a user's head;

a second housing comprising:

a photosensor operatively connected to the second housing, the photosensor being configured for detecting ambient light and for generating an electrical signal corresponding to the detected ambient light;

a light-emitting diode operatively connected to the second housing, wherein the light-emitting diode is configured to emit visible light having a luminous flux that varies based at least in part on the electrical signal generated by the photosensor such that the luminous flux of the light emitted by the light-emitting diode decreases in response to an increase in the detected ambient light and increases in response to a decrease in the detected ambient light; and a heat sink defining at least a portion of a rear-wall outer surface of the second housing facing the first housing and configured for dissipating heat generated by the light-emitting diode;

wherein a first portion of the second housing is pivotably connected to the first housing enabling pivotable movement of the second housing between a forward-looking position relative to the first housing and a downward-looking position relative to the first housing, and a second portion of the second housing engages at least a portion of the first housing's retention member, wherein the outwardly extending retention member has a generally arcuate profile and at least partially surrounds the second housing and the heat sink in both the forward-looking position and the downward-looking position to preclude a user from touching the heat sink in both the forward-looking position and the downward-looking position.

2. The wearable headlamp of claim 1, further comprising:

at least one user input device; and a control circuit configured for controlling the light-emitting diode and for switching among two or more illumination modes in response to input received via the user input device, wherein the two or more illumination modes comprise:

a constant brightness mode in which the light-emitting diode emits visible light having a constant luminous flux; and an auto-dim mode in which the light-emitting diode emits visible light having a luminous flux that varies based at least in part on the electrical signal generated by the photosensor.

3. The wearable headlamp of claim 2, wherein the constant brightness mode comprises a first constant brightness mode in which the light-emitting diode emits visible light having a first luminous flux;

wherein the illumination modes further comprise a second constant brightness mode in which the light-emitting diode emits visible light having a second luminous flux that is less than the first luminous flux.

4. The wearable headlamp of claim 2, wherein the light-emitting diode is a first light-emitting diode and the wearable headlamp further comprises a second light-emitting diode operatively connected to the housing;

wherein the second light-emitting diode is configured to emit visible light in the red spectrum; and wherein the illumination modes further comprise a red light mode in which the second light-emitting diode emits visible light in the red spectrum and the first light-emitting diode does not emit visible light.

5. The wearable headlamp of claim 2, wherein the at least one user input device comprises a depressible button.

6. The wearable headlamp of claim 1, wherein the engagement of retention member with the second housing configured to hold the second housing in a stable position relative to the first housing absent deliberate force applied by a user and, upon application of deliberate force by a user, permit the second housing to pivot relative to the first housing in order to adjust the direction of visible light emitted from the light-emitting diode relative to the first housing.

7. The wearable headlamp of claim 6, wherein the second housing is configured to pivot between two or more mechanically defined positions relative to the first housing.

8. The wearable headlamp of claim 6, wherein at least one of the retention member and the second housing defines a plurality of spaced surface engagement features;

wherein at least one of the retention member and the second housing defines at least one mating surface engagement feature configured for engaging the spaced surface engagement features; and wherein engagement of the at least one mating surface engagement feature with at least one of the spaced surface engagement features holds the second housing in a stable position relative to the first housing absent deliberate force applied by a user and, upon application of deliberate force by a user, permits the second housing to pivot relative to the first housing such that the mating surface engagement feature engages another of the spaced surface engagement features, thereby adjusting the direction of visible light emitted from the light-emitting diode relative to the first housing.

9. The wearable headlamp of claim 8, wherein the plurality of spaced surface engagement features comprise a series of sequentially spaced dimples defined on the retention member; and wherein the at least one mating surface engagement feature comprises a rounded protrusion defined on the second housing.

10. The wearable headlamp of claim 1 wherein the outwardly extending retention member at least partially surrounds the second housing and prevents inadvertent user contact with the surface of the heat sink.

11. The wearable headlamp of claim 1, wherein the at least one fastener comprises a head band configured for being secured around a user's head, helmet, or other head-mounted apparatus.

* * * * *